United States Patent [19]

Schieferly

[11] Patent Number: 4,995,826

[45] Date of Patent: Feb. 26, 1991

[54] CONNECTOR HAVING AN IMPROVED SLIDE LATCH AND A SLIDE LATCH MEMBER THEREFOR

[75] Inventor: Stephen B. Schieferly, Harrisburg, Pa.

[73] Assignee: AMP Incorporated, Harrisburg, Pa.

[21] Appl. No.: 396,417

[22] Filed: Aug. 18, 1989

[51] Int. Cl.[5] ..... H01R 13/639

[52] U.S. Cl. ..... 439/347

[58] Field of Search ..... 439/342, 345, 347, 352, 439/359, 470, 545, 562, 563, 901; 248/56, 27.1; 285/325

[56] References Cited

U.S. PATENT DOCUMENTS

| | | | |
|---|---|---|---|
| 4,172,627 | 10/1979 | Ricros . | |
| 4,344,663 | 8/1982 | Ognier et al. | 439/347 |
| 4,367,003 | 1/1983 | Frantz . | |
| 4,544,225 | 10/1985 | Raus et al. | 439/345 |
| 4,568,135 | 2/1986 | Frantz . | |

OTHER PUBLICATIONS

AMP Catalog No. 79-546 revised Dec. 1984 and published Dec. 1984, pp. 88 and 89, 90 and 91.

AMP Instruction Sheet IS 6551 released Jul. 30, 1982.

AMP Catalog No. 79-547, cover sheet and pp. 44 and 45, issued Dec. 1980.

*Primary Examiner*—Eugene F. Desmond

*Assistant Examiner*—Walter G. Hanchuk

*Attorney, Agent, or Firm*—David L. Smith

[57] ABSTRACT

A connector (12) having a slidelatch member (50) or a slidelatch member (50) adapted to be slidingly secured on a connector (12) by a pair of slidelatch securing posts (56, 58) wherein the slidelatch member (50) is movable laterally between a latched first position and an unlatched second position. The slidelatch member (50) has an elongate base member (60) which defines first and second transverse end portions (66, 68) each having side edges. The base member (60) has an aperture (70) adapted to receive the shroud (72) of the connector (12), and slot means (74, 76) proximate the slidelatch securing posts (56, 58) adapted to permit the slidelatch member (50) to move between the latched first position and the unlatched second position. The slidelatch member (50) further has overturned extensions (80, 82) extending from the transverse end portions (66, 68). Side rails (62, 64) on the slidelatch member (50) extend between the first and second transverse end portions (66, 68) and are integral with side edges thereof. The side rails (62, 64) have structure that cooperates with at least one of the overturned extensions (80, 82) to prevent relative movement between the overturned extension (82, 84) and the side rails (62, 64).

15 Claims, 4 Drawing Sheets

CONNECTOR HAVING AN IMPROVED SLIDE LATCH AND A SLIDE LATCH MEMBER THEREFOR

BACKGROUND OF THE INVENTION

This invention relates to a latching mechanism for securing electrical connectors in a mated condition and in particular to a slide latch that will withstand greater forces that tend to unmate the connectors, and permits slide latches to be used when stacking connectors or when mounting connectors in closer side-by-side spacing than when prior art slide latches were employed.

Slide latches for securing two connectors together are disclosed in U.S. Pat. Nos. 4,367,003 and 4,568,135, the disclosures of which are hereby incorporated by reference. The latching member in the prior art slide latches has spaced side rails that extend beyond the profile of the connectors secured together and thereby necessitate that connector assemblies including such slide latches occupy more space for mounting than connectors not including such a slide latch. Furthermore, the slide latches could withstand forces tending to unmate the mated connectors secured by the slide latch up to about forty pounds. When the known slide latches are subjected to greater forces tending to unmate the mated connectors secured thereby, the slide latch failed with the result that the connectors could not be assured of being maintained in a mated position.

SUMMARY OF THE INVENTION

In accordance with the present invention, a connector having slidelatch member, or a slide latch member adapted to be mounted on a connector by a pair of slidelatch securing posts wherein the slide latch member is movable laterally between a latched first position and an unlatched second position The slide latch member has an elongate base member which defines first and second transverse end portions each having side edges. The base member has an aperture adapted to receive the shroud of a connector and slot means proximate slide latch securing posts adapted to permit the slide latch member to move between the latched first position and the unlatched second position. The slide latch member further has overturned extensions extending from the transverse end portions. Side rails on the slide latch member extend between the first and second transverse end portions and are integral with the side edges thereof. The side rails have structure that cooperates with at least one of the overturned extensions to prevent relative movement between the overturned extension and the side rails.

DESCRIPTION OF THE PREFERRED EMBODIMENT

Figure 1:
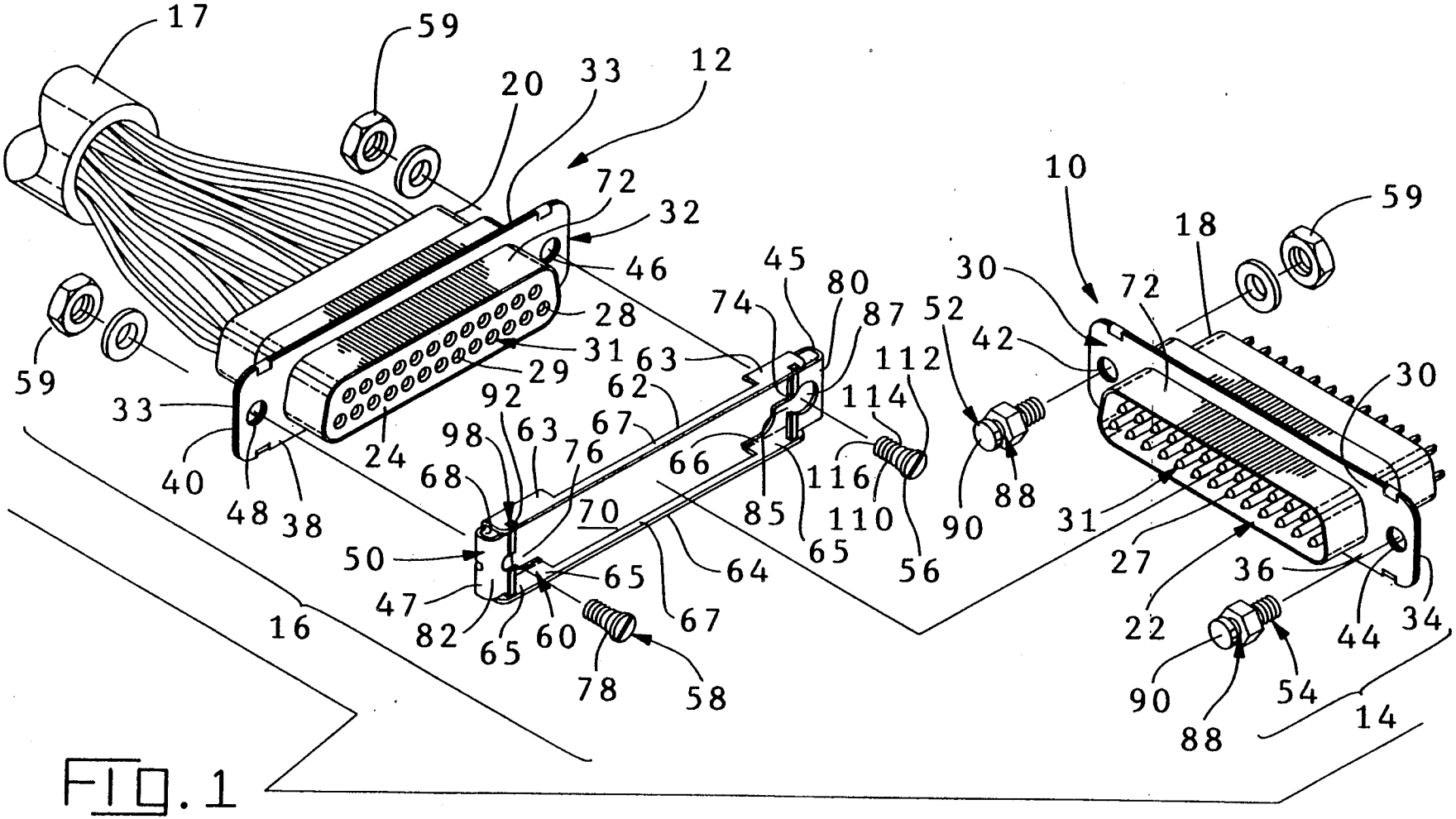
FIG. 1 is an exploded isometric view of a pair of complimentary matable connectors having a latching system including a latching member in accordance with the present invention.
Figure 2:
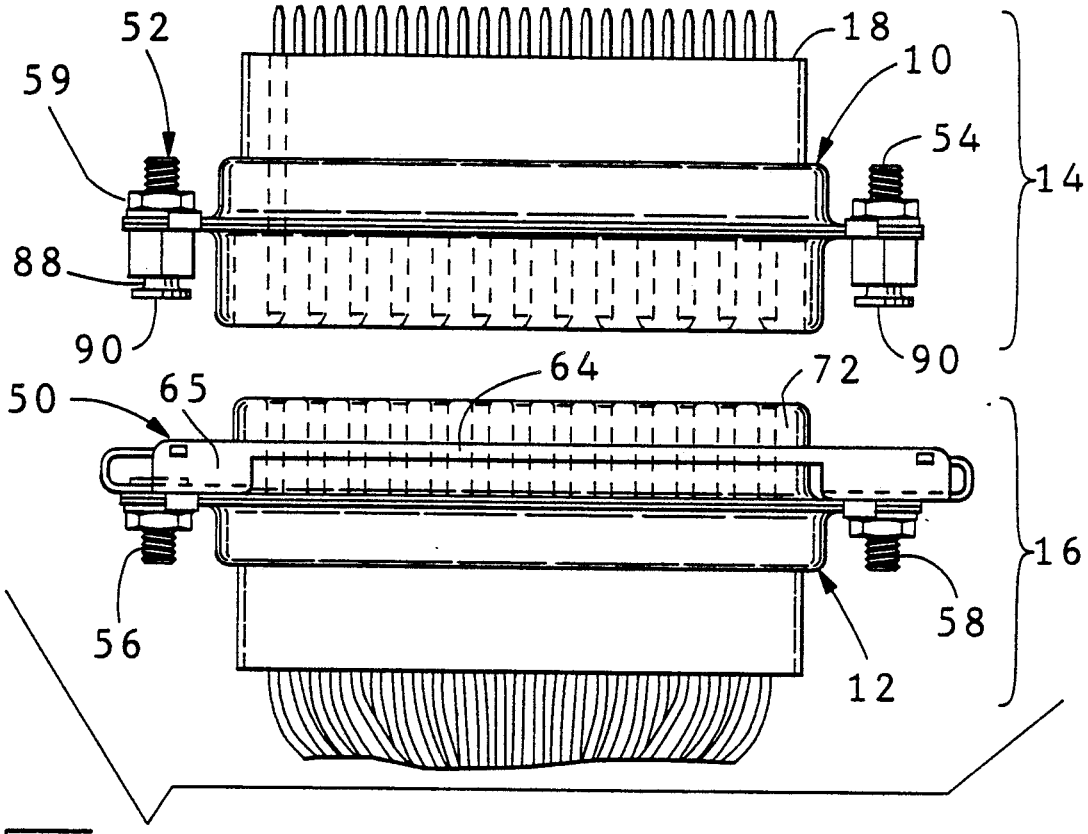
FIG. 2 is a side elevation view, partly in section, of the complimentary connectors and latching system in an unmated and unlatched condition.
Figure 3:
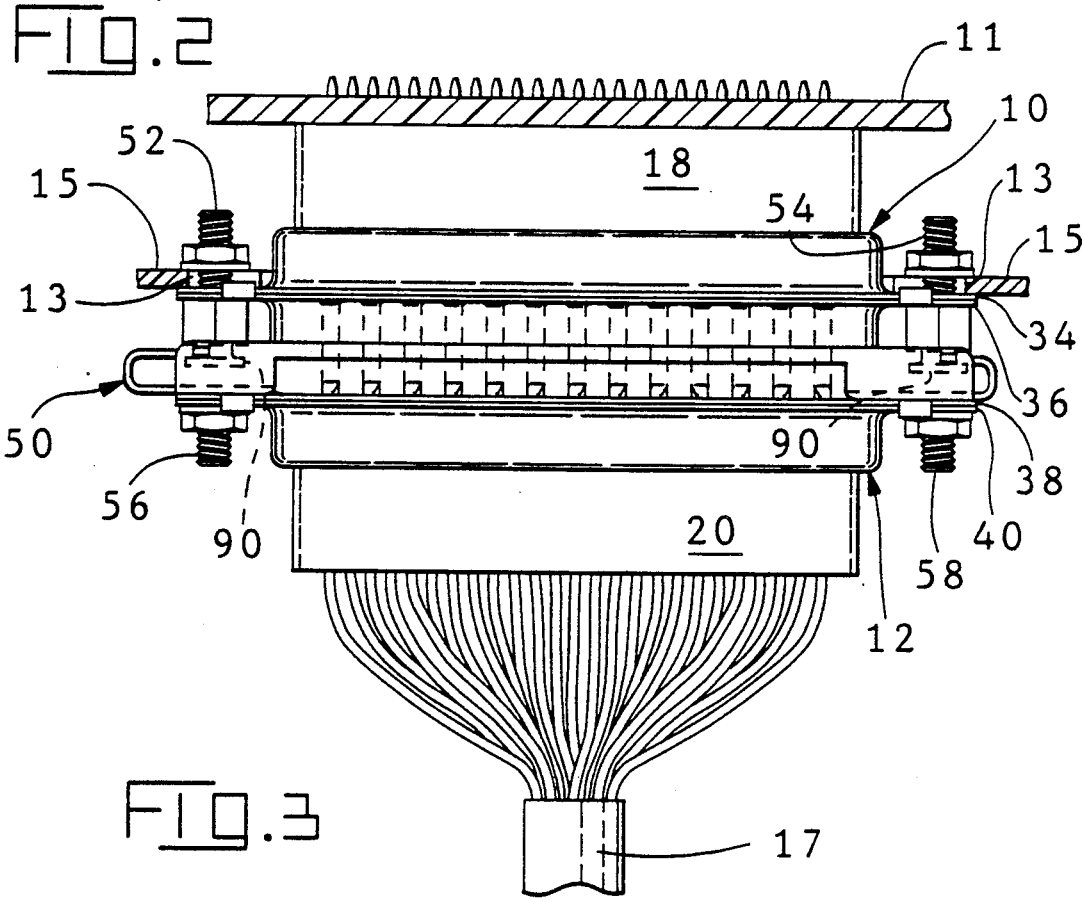
FIG. 3 is a side elevation view, partly in section, of the complimentary connectors and latching system in a mated and latched condition.

A slide latch system is shown in FIGS. 1–3 for securing a pair of known matable connectors in a mated position. The connectors may be of the type shown in U.S. Pat. Nos. 3,101,229, 3,879,099 or 4,062,616, the disclosures of which are hereby incorporated by reference. Matable connectors 10 and 12 are each a part of respective connector assemblies 14 and 16. Connector 10 is a plug member and connector 12 is a receptacle member. In the preferred embodiment, connector 12 is terminated to cable 17 whereas connector 14 is a printed circuit board 11 mounted connector that typically will protrude through an aperture 13 in a panel 15 to mate with connector 12, however, the invention is not limited thereto.

Connectors 10 and 12 each include housings 18,20 molded of an insulative thermoplastic material having a mating face 22,24 having a plurality of contact receiving passages 28 extending rearward therefrom having pins 27 and sockets 29, respectively secured therein. Pins 27 and sockets 29 are individually or collectively referred to as contacts 31. Each matable connector 10,12 has an integral flange 30,32 either in housing 18,20, or as shown in the preferred embodiment in a two piece metal shell 34,36, and 38,40 and closing and shielding the housing 18,20 in the region of contacts 31. Each flange 30,32 has a pair of spaced apertures 42,44 and 46,48 near the ends of a respective flange.

The slide latch system includes an elongate latching member 50, a pair of slide latch locking posts 52,54 received and secured in apertures 42,44 of connector 10, and a pair of slide latch securing posts 56,58 received and secured in apertures 46,48 of connector 12. Locking posts 52,54 and securing posts 56,58 may be secured in any known manner such as by threaded engagement with nuts 59 on the back of the respective flange 30,32.

As best seen in FIGS. 1 and 4 through 6, latching member 50 has a generally channel shape formed by base member 60 and a pair of integral parallel side rails 62,64 which have respective enlarged portions 63,65 near the ends thereof. Side rails 62,64 are joined to base 60 through a limited length of enlarged portions 63,65 by transverse portions 66,68. Side rails 63,65 are formed to be substantially perpendicular to base 60 such that the limited length of enlarged portions 63,65 that join base 60 forms a 90° bend. Narrow portion 67 of side rails 62,64 accommodates a backshell cover (not shown) that extends over flange 30 between enlarged portions 63,65 of a cable mounted connector 12.

Figure 7:
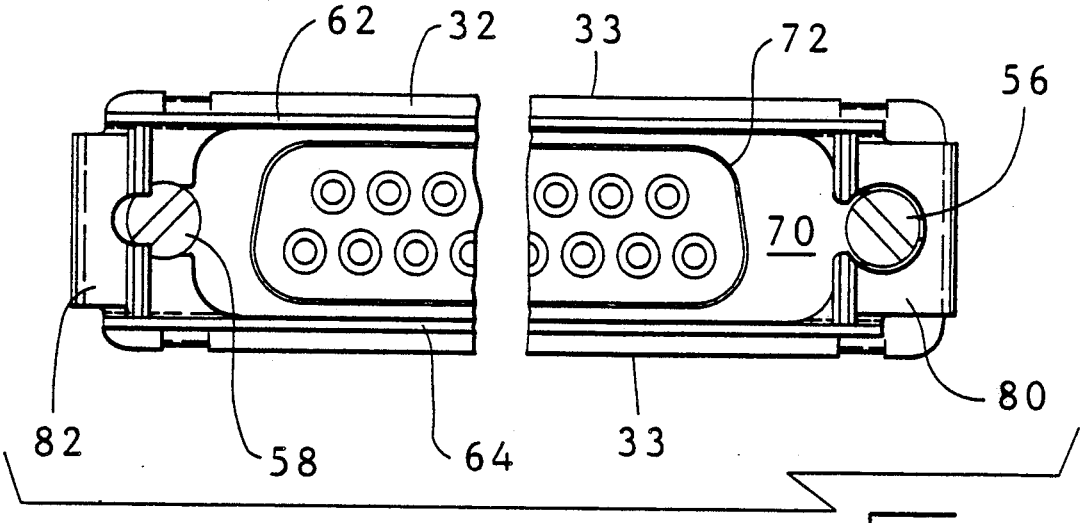
FIG. 7 is a front view of the connector assembly including a latching member.

As best seen in FIG. 7, side rails 62,64 are substantially the thickness (nominally 0.023 inch) of the material (preferably stainless steel) from which latching member 50 is stamped and formed and further, side rails 62,64 are within the profile of the outer periphery 33 of flange 32 of connector 12 on which latching member 50 is secured, as well as being within the periphery of flange 30 of complementary connector 10. Since side rails 62,64 are within the profile of flange 32, connectors 14 may be mounted closer together when employing latching member 50 than when utilizing prior art slide latches. Furthermore, providing a slide latch with the side rails within the profile of the periphery of the connector permits a slide latch to be utilized in connector stacking applications.

Profiled opening 70 is generally similar in shape to shroud 72 and accommodates shroud 72 of connector 12 as latching member 50 moves laterally between a latched position and an unlatched position. Slots 74,76 in transverse portion 66,68 of base 60 are at least coextensive with apertures 46,48 and accommodate slide latch securing posts 56,58 which slidingly secure latching member 50 to connector assembly 16. Slots 74,76 may be an extension of profiled opening 70, are of sufficient length to permit lateral movement of latching member 50 between a latched position and an unlatched position, and function to constrain base 60 of latching member 50 to slide along metal shell 38 between a shoulder 78 on slide latch securing posts 56,58 and metal shell 38. At each end 45,47 of latching member 50, overturned extensions 80,82 extend from transverse portion 66,68 fold back over base 60 and lie substantially parallel thereto. Slots 84,86 in overturned extensions 80,82 overlie slots 74,76 respectively in parallel spaced relationship. Slots 84,86 are sized and spaced to engage in channel 88 of slide latch locking posts 52,54. Slot 84 is a substantially straight slot while slot 86 has a narrow opening neck 85 extending into an enlarged opening 87 adequate in size and shape to accommodate the retention head 90 of slide latch locking post 52.

Figure 4:
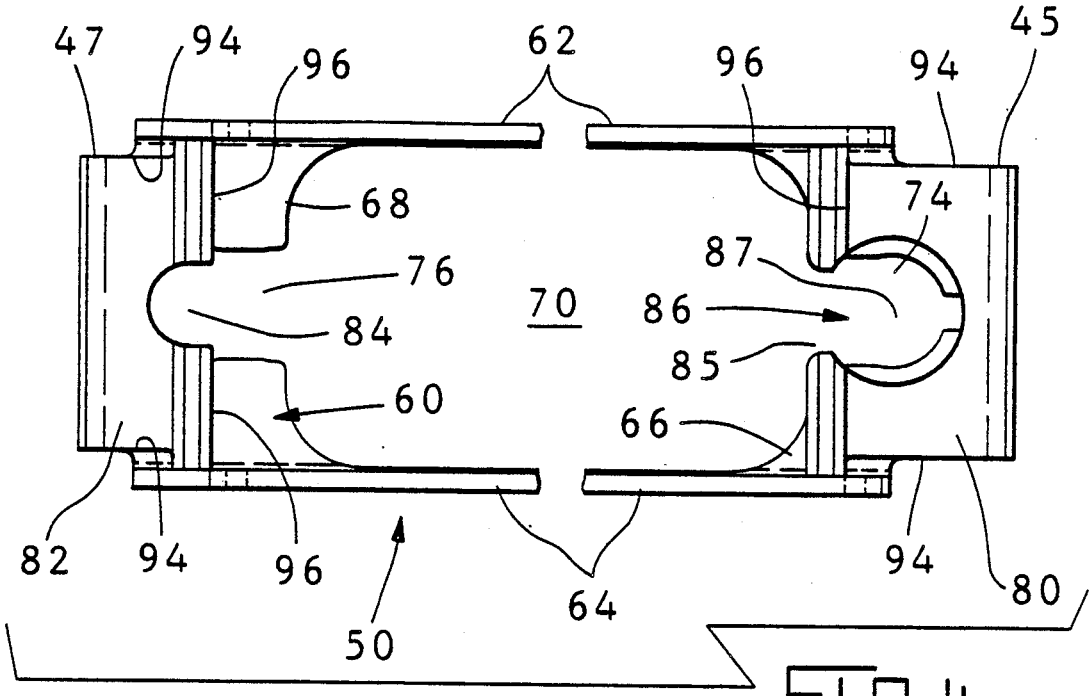
FIG. 4 is a top view of the latching member shown in FIG. 1.
Figure 5:
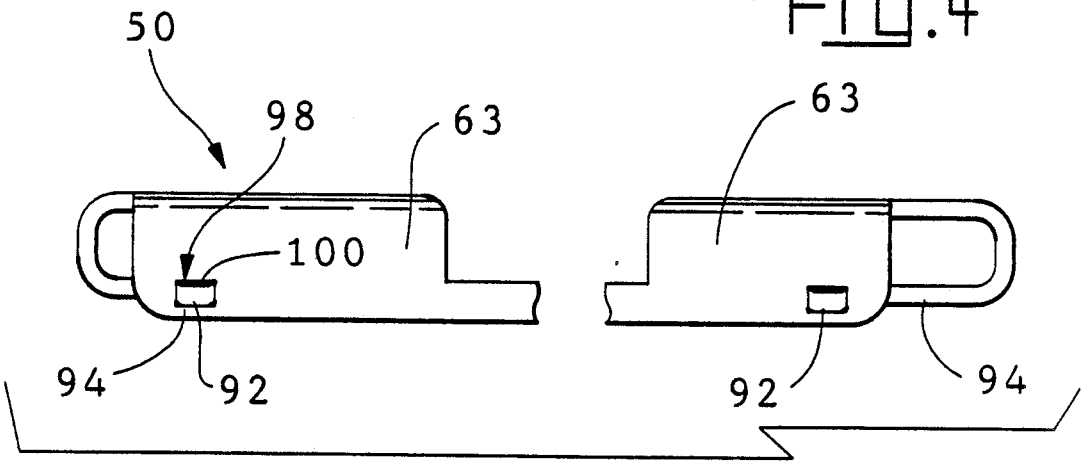
FIG. 5 is a side view of the latching member.
Figure 6:
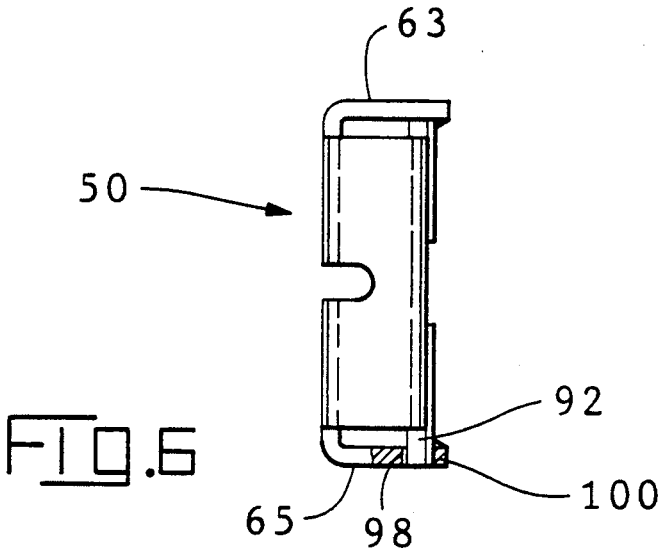
FIG. 6 is an end view, partly in section, of the latching member.

The side rails and overturned extensions have means that cooperate to prevent relative movement therebetween subsequent to manufacture. In the preferred embodiment as best seen in FIGS. 4 through 6, tabs 92 extend laterally from side edges 94 of overturned extensions 80,82, proximate ends 96, substantially the thickness of side rails 62,64. Tabs 92 are received in apertures 98 in the enlarged portion 63,65 of side rails 62,64. Forces tending to unmate mated connectors 10 and 12 with latching member 50 in the latched position are transmitted through tab 92 to a wall 100 of aperture 98. In this manner, forces applied to cable 17 or connector 12 that tend to unmate connectors 10 and 12, while latching member 50 is in the latched position securing mated connectors 10 and 12 together are transmitted from connector 12 to slide latch securing posts 56,58 thence to overturned extensions 80,82, thence through tabs 92 and walls 100 to enlarged portions 63,65 as well as through ends 45,47 to transverse portions 66,68, thence to slide latch locking posts 52,54 and connector 10.

With tabs 92 received in aperture 98, and with latching member 50 is in the latched position securing mated connectors 10 and 12 together latching member 50 can withstand greater forces applied to cable 17 or connector 12 that tend to unmate connectors 10 and 12 than could be previously withstood by prior art slide latches.

Figure 8:
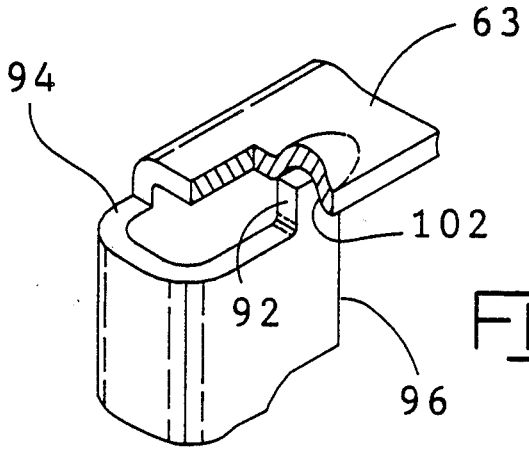
FIG. 8 is an alternate embodiment overturned extension retention means.
Figure 9:
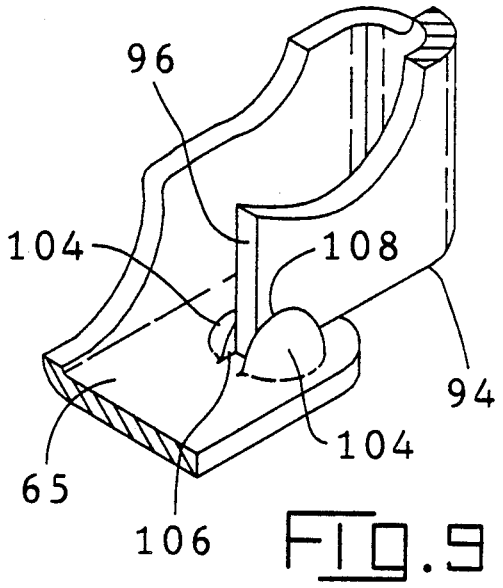
FIG. 9 is another alternate embodiment overturned extension retention means.
Figure 10:
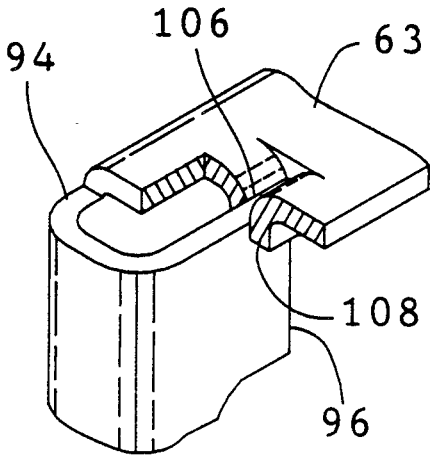
FIG. 10 is yet another alternate embodiment overturned extension retention means.

While tabs 92 in the preferred embodiment have been described as being received in aperture 98 of side rails 62,64, they could equally be received in a recess 102 stamped in a side rail as shown in the alternate embodiment of FIG. 8. Furthermore, side rails 62,64 could have structure extending therefrom to engage overturned extensions 82,84 to provide the same function, such as a pair of spaced protrusions 104 providing spaced shoulders 106 and 108 between which is received overturned extensions 82,84 as shown in the alternate embodiments of FIGS. 9 and 10.

Latching member 50 is stamped and formed on strip with apertures 70 and 98 punched. Overlying ends 80,82 are then stamped and formed to overlie base 60. Subsequently, side rails 60,62 are formed perpendicular to base 60 such that tabs 92 are received in aperture 98, or recess 102, or overturned ends 80,82 are received between shoulders 106 and 108. In this manner, the side rails cooperate with the overturned extensions to prevent deformation of the overturned extensions or relative movement therebetween when subjected to forces that tend to unmate the connectors secured together by the latching system.

The operation of the latching system is best understood with reference to FIGS. 2 and 3. FIG. 2 shows connectors 10 and 12 of the slide latch system in an unmated, unlatched position. Latching member 50 is moved laterally, to the right in FIG. 2, and positioned to allow retention head 90 of slide latch locking post 54 to move past overturned extension 82 and to allow retention head 90 of slide latch locking post 52 to enter slot 86 as connectors 10 and 12 are mated. Latching member 50 is then moved laterally, to the left in FIG. 2, to position slot 84 and channel 88 of slide latch locking post 54 as well as to position slot 86, and more specifically the narrow open neck 87 of slot 86, in channel 88 of slide latch locking post 52, thus securing the slide latch in a latched position latching mated connectors 10 and 12 together.

Slide latch securing posts 56,58 slidingly secure latching member 50 to connector assembly 16. Slide latch securing posts 56,58 have a shank sized to be received in apertures 46,48 in flanges 38,40 of connector assembly 16. Slide latch securing posts 56,58 have a flange 112 which defines first shoulder 78 and an offset in diameter which defines second shoulder 114. With a slide latch securing post 56,58 received in a slot 74,76 and aperture 46,48, second shoulder 114 engages the surface of flange 38 and free end 116 of shank 110 extends beyond flange 40. First shoulder 78 is spaced from second shoulder 114 axially along slide latch securing post 56,58 substantially the thickness of base 60 of latching member 50, plus a tolerance.

Slide latch securing posts 56,58 are secured to a connector assembly 16 as flanges 38,40 are sandwiched between free end 116 of shank 110 and second shoulder 114. Latching member 50 is slidable within slot 74,76 transverse to the axis of slide latch securing posts 56,58 but constrained from moving in the axially direction of slide latch securing posts 56,58 due to the constraint imposed by first shoulder 78.

I claim:

1. A latching member for mounting on a connector having slide latch securing means, the latching member movable laterally between a latched first position and an unlatched second position, the latching member comprising:

a base member defining first and second transverse end portions having side edges, said base member having an aperture adapted to receive a portion of the connector, and slot means proximate said aperture, said slot means adapted to receive the slide latch securing means as the latching member moves between the latched first position and the unlatched second position;

overturned extensions extending from the transverse end portions; and side rails extending between said first and second transverse end portions and integral with side edges thereof, at least one of said side rails having means for cooperating with at least a respective one of said overturned extensions to prevent relative movement therebetween.

2. A latching member as recited in claim 1 wherein the side rail cooperating means comprises a recess.

3. A latching member as recited in claim 2 wherein the latching member further comprises a tab adapted to be received in the recess, the tab extending from an edge of said respective overturned extension, whereby the tab is received in the recess to prevent relative movement.

4. A latching member as recited in claim 1 wherein the side rail cooperating means comprises an aperture.

5. A latching member as recited in claim 4 wherein the latching member further comprises a tab adapted to be received in the aperture, the tab extending from an edge of said respective overturned extension, whereby the tab is received in the aperture to prevent relative movement.

6. A latching member as recited in claim 1 wherein the side rail cooperating means comprises a shoulder for engaging the respective one of said overturned extensions.

7. A latching member as recited in claim 1 wherein the side rail cooperating means comprises a pair of shoulders for securing therebetween the respective one of said overturned extensions.

8. An electrical connector for mating and securing to a complementary connector, the complementary connector having a pair of spaced slide latch locking means;

a housing having spaced slide latch securing means;

a latching member having a base member defining first and second transverse end portions each having side edges, said base member having an aperture adapted to receive a portion of the housing, and slot means proximate said aperture, said slot means adapted to receive the slide latch securing means as the latching member moves between a latched first position and an unlatched second position;

overturned extensions extending from the transverse end portions of said latching member; and side rails on said latching member extending between said first and second transverse end portions and integral with a portion side edges thereof, at least one of said side rails having means for cooperating with a respective one of said overturned extensions to prevent relative movement therebetween.

9. An electrical connector as recited in claim 8 wherein the side rail cooperating means comprises a recess.

10. An electrical connector as recited in claim 9 wherein the latching member further comprises a tab adapted to be received in the recess extending from an edge of said respective overturned extension, whereby the tab is received in the recess to prevent relative movement.

11. An electrical connector as recited in claim 8 wherein the side rail cooperating means comprises an aperture.

12. An electrical connector as recited in claim 11 wherein the latching member further comprises a tab adapted to be received in the aperture, the tab extending from an edge of said respective overturned extension, whereby the tab is received in the aperture to prevent relative movement.

13. An electrical connector as recited in claim 8 wherein the side rail cooperating means comprises a shoulder for engaging the respective one of said overturned extensions.

14. An electrical connector as recited in claim 8 wherein the side rail cooperating means comprises a pair of shoulders for securing therebetween the respective one of said overturned extensions.

15. An electrical connector as recited in claim 8 wherein the periphery of the housing defines a profile, the side rails being within the profile of the housing.

* * * * *